US006863038B2

(12) United States Patent
Yamauchi

(10) Patent No.: US 6,863,038 B2
(45) Date of Patent: Mar. 8, 2005

(54) VALVE DRIVING APPARATUS AND INTERNAL COMBUSTION ENGINE INCLUDING THE SAME

(75) Inventor: Kosaku Yamauchi, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 10/746,898

(22) Filed: Dec. 24, 2003

(65) Prior Publication Data

US 2004/0139935 A1 Jul. 22, 2004

(30) Foreign Application Priority Data

Dec. 27, 2002 (JP) ..... 2002-382022

(51) Int. Cl.[7] ..... F01L 1/34

(52) U.S. Cl. ..... 123/90.18; 123/90.16; 123/90.31; 123/90.6

(58) Field of Search ..... 123/90.16, 90.18, 123/90.27, 90.31, 90.6, 90.15, 90.17, 90.39, 90.44, 90.48; 74/559, 567, 569

(56) References Cited

U.S. PATENT DOCUMENTS 5,159,906 A * 11/1992 Fontichiaro et al. ..... 123/90.18
5,445,117 A * 8/1995 Mendler ..... 123/90.16
6,520,135 B2 * 2/2003 Sugawara ..... 123/90.48
6,523,510 B2 * 2/2003 Asanomi et al. ..... 123/90.16
2003/0047154 A1 * 3/2003 Sugawara

FOREIGN PATENT DOCUMENTS

JP 04-187807 A1 7/1992
JP 09296707 A * 11/1997 ..... F01L/1/46
JP 2002235515 A * 8/2002 ..... F01L/13/00
JP 2002-364319 A1 12/2002
JP 2003-003811 A1 1/2003
JP 2003-003812 A1 1/2003
JP 2003-041914 A1 2/2003
JP 2003-201814 A1 7/2003

OTHER PUBLICATIONS

Patent Abstracts of Japan for JP04–187807 published on Jul. 6, 1992.
Patent Abstracts of Japan for JP2003–003811 published on Jan. 8, 2003.
Patent Abstracts of Japan for JP2002–364319 published on Dec. 18, 2002.
Patent Abstracts of Japan for JP2003–003812 published on Jan. 8, 2003.
Patent Abstracts of Japan for JP2003–041914 published on Feb. 13, 2003.
Patent Abstracts of Japan for JP2003–201814 published on Jul. 18, 2003.

* cited by examiner

*Primary Examiner*—Thomas Denion
*Assistant Examiner*—Ching Chang
(74) *Attorney, Agent, or Firm*—Darby & Darby

(57) ABSTRACT

A shim attaching and detaching surface has a sectional portion with a smaller diameter than a base circle of a cam surface in a state in which the shim attaching and detaching surface of a cam is located on a tappet roller, and therefore the tappet roller and an arm member can be moved upward. Since an inner side of a top surface of a tappet guide is inclined, if the arm member is tilted along this inclination, one end of the arm member can be raised, and a clearance is formed in a space from a tappet shim. Accordingly, by inserting a slim plate-shaped or rod-shaped jig 128 from the clearance, the tappet shim $\mathbf{37}_{EX}$ can be attached and detached.

6 Claims, 10 Drawing Sheets

VALVE DRIVING APPARATUS AND INTERNAL COMBUSTION ENGINE INCLUDING THE SAME

CROSS-REFERENCE TO RELATED APPLICATIONS

This application is based upon and claims the benefit of priority from the prior Japanese Patent Application No. 2002-382022, filed on Dec. 27, 2002, the entire contents of which are incorporated herein by reference.

BACKGROUND OF THE INVENTION

1. Field of the Invention

The present invention relates to a valve driving apparatus and an internal combustion engine including the same in a motorcycle, automobile or the like.

2. Description of the Related Art

In an internal combustion engine, combination of a variable phase and cam switching begins to appear recently, and thereafter, a method with use of a three-dimensional cam for making the operation angle and the lift amount continuously variable is proposed. For example, there is a method in which a follow-up mechanism for a change in a contact angle is provided at a top portion of a direct striking type cylinder tappet, and by sliding the three-dimensional cam in an axial direction, the valve lift amount is made continuously variable.

This type of three-dimensional cam is provided extensively with a cam portion inclined in a longitudinal direction (axial direction of a camshaft), and is formed in a shape to continuously change the valve lift amount. In this case, setting is made such that a cam operation angle and lift timing are changed synchronously with cam height so as to have a desired lift curve. By moving such a cam along the camshaft, the lift amount, the operation angle and lift timing of a valve can be controlled to be continuously variable.

By applying such a three-dimensional cam to the intake valve, a throttle valve to form a mixture is removed, and a so-called non-throttle valve engine can be realized. By removing the throttle valve, intake pressure inside an intake port becomes atmospheric pressure or negative pressure close to it with pulsation being averaged, and therefore a lift amount, opening timing and time of the intake valve with respect to, for example, engine speed differ. This is because the conventional engine is developed on the premise that the throttle valve is included, and the intake amount into the cylinder is adjusted with the intake valve, after the flow (pressure) is firstly adjuster with the throttle valve. There is some which change the operation of the intake valve a little among them, but rotation control and output control are performed depending on that the intake passage is throttled with the throttle valve, and if the throttle valve is removed, the control cannot be made at all. In the present invention, the condition of the intake pressure inside the intake port differs, and therefore size and setting of each part totally differ. Even if a component is explained by the same name for convenience of explanation, the role played by it is totally different.

[Patent Document 1]

Japanese Patent Laid-open No. 4-187807

Incidentally, in this type of valve driving apparatus, a slide mechanism of a three-dimensional cam, a mechanism in contact with a three-dimensional cam to advance and retreat the valve and the like are included, and therefore assembling easiness and the like in these mechanisms are required.

SUMMARY OF THE INVENTION

The present invention is made in view of the above circumstances, and has its object to increase assembling easiness and the like in the slide mechanism of the cam, and the advancing and retreating mechanism for the valve, in the valve driving apparatus constituted to control the valve lift amount and the valve actuated angle continuously variable by the cam sliding.

A valve driving apparatus of the present invention is a valve driving apparatus comprising a cam, with a cam surface being formed so that cam height and a cam operation angle continuously change, constituted to be rotated integrally with a camshaft and slidable in an axial direction thereof, and a valve lifter pressed by the cam surface of the aforesaid cam to advance and retreat a valve via a shim, so that continuously variable control of a valve lift amount and a valve actuated angle is performed by the aforesaid cam sliding in the axial direction of the camshaft, and is characterized in that the aforesaid cam is provided with a shim attaching and detaching surface with a clearance being secured between the aforesaid valve lifter and a shim of the valve to make the shim attachable and detachable from the clearance.

Another valve driving apparatus of the present invention is a valve driving apparatus comprising a cam, with a cam surface being formed so that cam height and a cam operation angle continuously change, constituted to be rotated integrally with a camshaft and slidable in an axial direction thereof, and a valve lifter pressed by the cam surface of the aforesaid cam to advance and retreat a valve, so that continuously variable control of a valve lift amount and a valve actuated angle is performed by the aforesaid cam sliding in the axial direction of the camshaft, and is characterized by comprising a key groove parallel in an axial direction, formed on an outer circumference surface of the camshaft; a key fitted into the aforesaid key groove; and a bearing assembly having balls at a plurality of spots in a circumferential direction, and in that the aforesaid bearing assembly is interposed between the aforesaid cam and the camshaft, and the balls are engaged with a space between the inner circumference surface of the aforesaid cam and both ends of the key at the outer circumference surface of the camshaft to restrain the aforesaid cam from being relatively rotated with the camshaft and make the aforesaid cam slidable in the axial direction thereof.

An internal combustion engine of the present invention is an internal combustion engine for controlling intake and exhaust by intake vales and exhaust vales, and characterized by comprising any one of the valve driving apparatuses of the above-described present invention.

DETAILED DESCRIPTION OF THE PREFERRED EMBODIMENTS

First Embodiment

Figure 1:
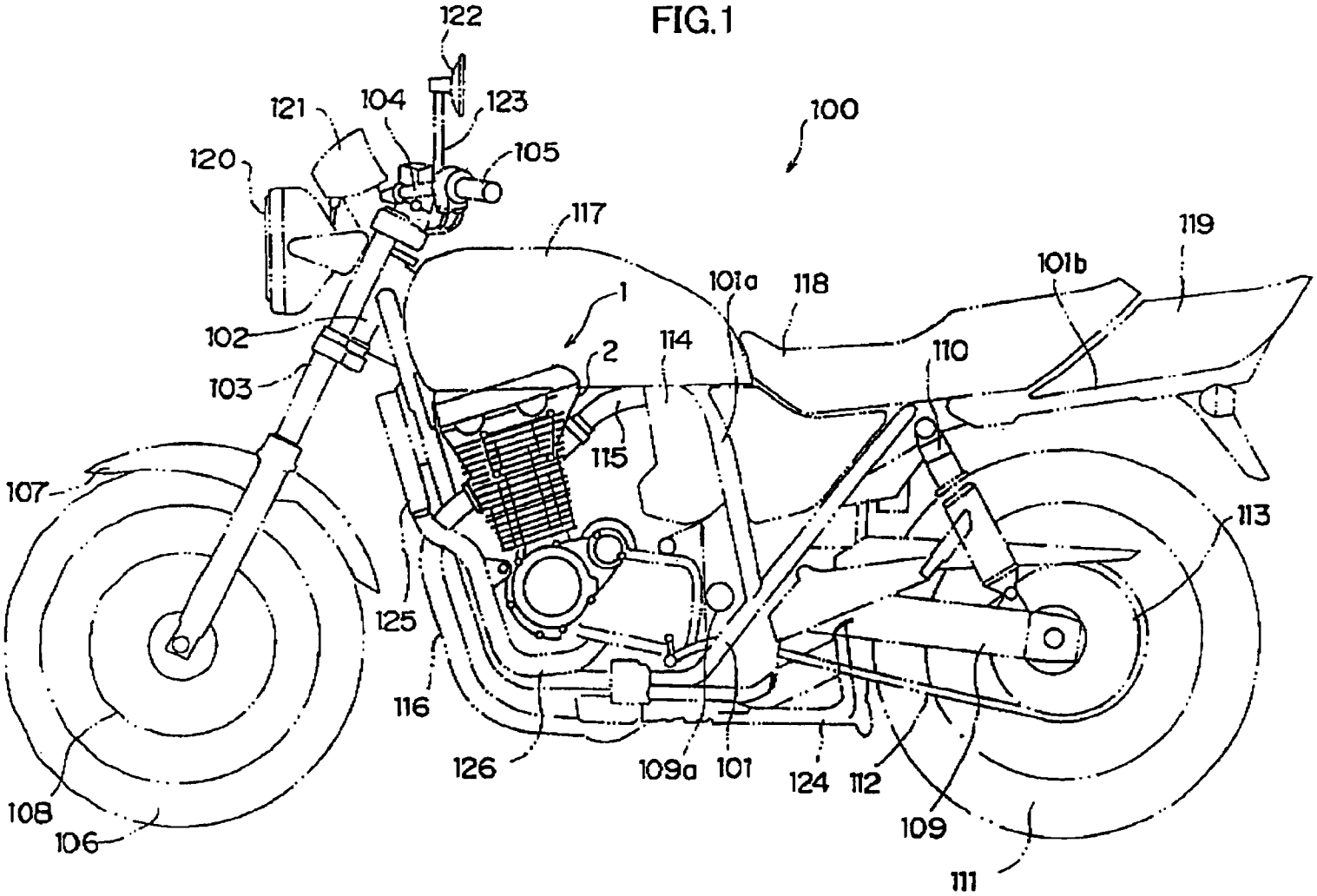
FIG. 1 is a view showing a constitution example of a motorcycle including an engine and its peripheral part according to an application example of the present invention.

A preferred embodiment according to the present invention will be explained hereinafter based on the drawings. A valve moving mechanism according to the present invention is effectively applicable to various types of gasoline engines loaded on motorcycles or automobiles, and in this embodiment, an engine of a motorcycle, is taken as an example, as shown in FIG. 1, for example.

First, an entire constitution of a motorcycle 100 according to this embodiment will be explained. In FIG. 1, two front forks 103 supported rotatably clockwise and counter-clockwise by a steering head pipe 102 are provided at a front part of a vehicle body frame 101 made of steel or an aluminum alloy material. A handle bar 104 is fixed to top ends of the front forks 103, and grips 105 are equipped at both ends of the handle bar 104.

A front wheel 106 is rotatably supported at a lower part of the front fork 103, and a front fender 107 is fixed to cover an upper portion of the front wheel 106. The front wheel 106 has a brake disc 108 which rotates integrally with the front wheel 106.

A swing arm 109 is swingably provided at a rear part of the vehicle body frame 101, and a rear shock absorber 110 is mounted between the vehicle body frame 101 and the swing arm 109.

A rear wheel 111 is rotatably supported at a rear end of the swing arm 109, and the rear wheel 111 is rotationally driven via a driven sprocket 113 with a chain 112 wound around it.

A mixture is supplied to an engine unit 1 loaded on the vehicle body frame 101 from an intake pipe 115 connected to an air cleaner 114, and an exhaust gas after combustion is exhausted through an exhaust pipe 116. The air cleaner 114 is placed behind the engine unit 1 and in a large space under a full tank 117 and a sheet 118 to secure a volumetric capacity. Consequently, the intake pipe 115 is connected to a rear side of the engine unit 1, and the exhaust pipe 116 is connected to a front side of the engine unit 1.

The fuel tank 117 is loaded at an upper position from the engine unit 1, and the seat 118 and a seat cowl 119 are connectively provided behind the fuel tank 117.

Further, in FIG. 1, reference numeral 120 denotes a head lamp, reference numeral 121 denotes a meter unit including a speed meter, a tachometer, various kinds of indicator lamps or the like, and reference numeral 122 denotes a rear-view mirror supported by a handle bar 104 via a stay 123. A main stand 124 is swingably attached at a lower part of the vehicle body frame 101, which allows the rear wheel 111 to contact the ground and lift from the ground.

The vehicle body frame 101 is provided to extend diagonally downward to the rear from the head pipe 102 provided at the front part, and after it is bent to wrap a portion under the engine unit 1, it forms a pivot 109*a* which is a pivoted portion of the swing arm 109, and connects to a tank rail 101*a* and a seat rail 101*b*.

This vehicle body frame 101 is provided with a radiator 125 in parallel with the vehicle body frame to avoid interference with the front fender 107, and a cooling water hose 126 is placed along the vehicle body frame 101 from this radiator 125 and communicates with the engine unit 1 without interfering with the exhaust pipe 116.

Figure 2:
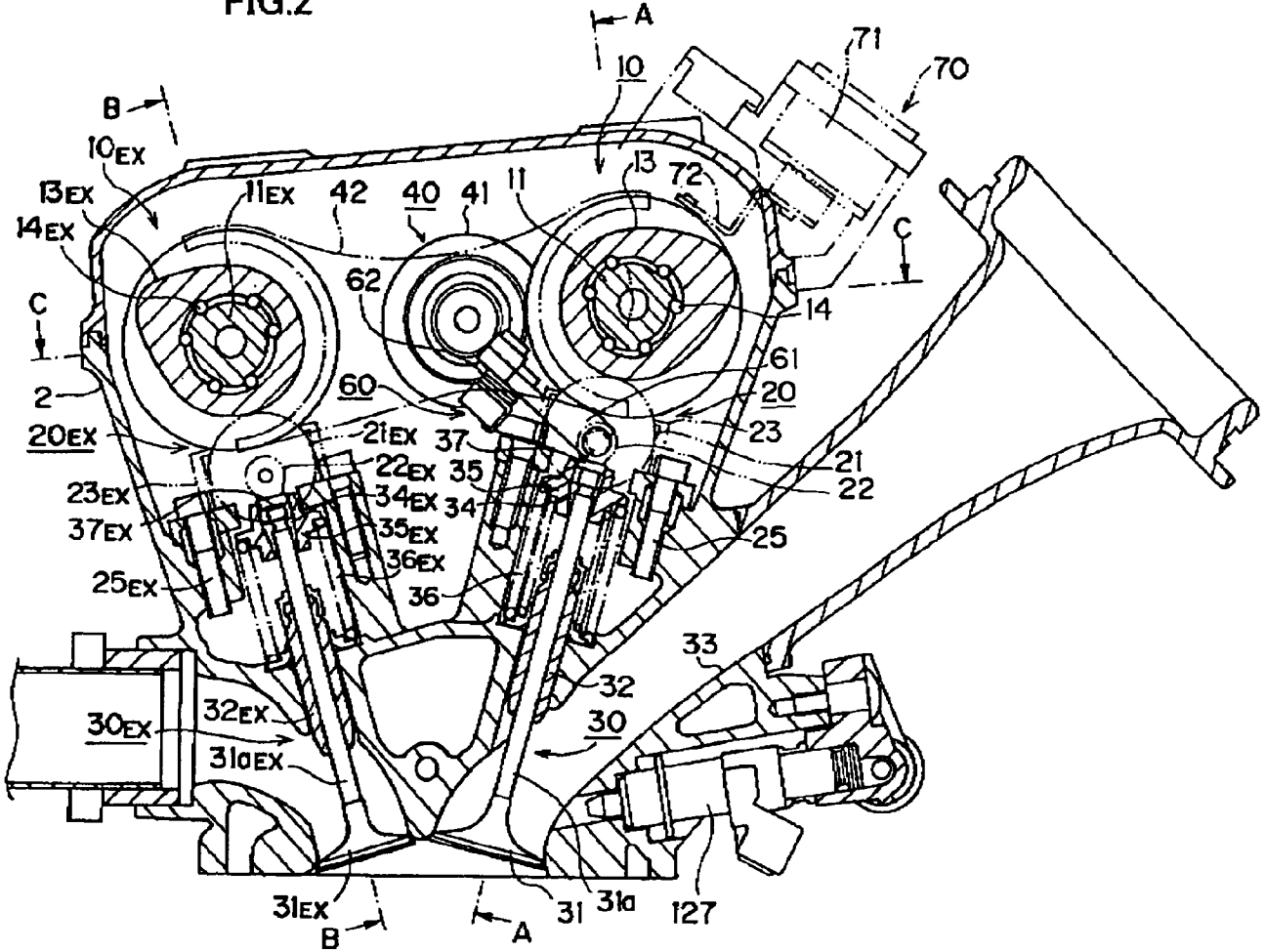
FIG. 2 is a sectional view showing an essential part of a valve driving apparatus of a first embodiment.
Figure 3:
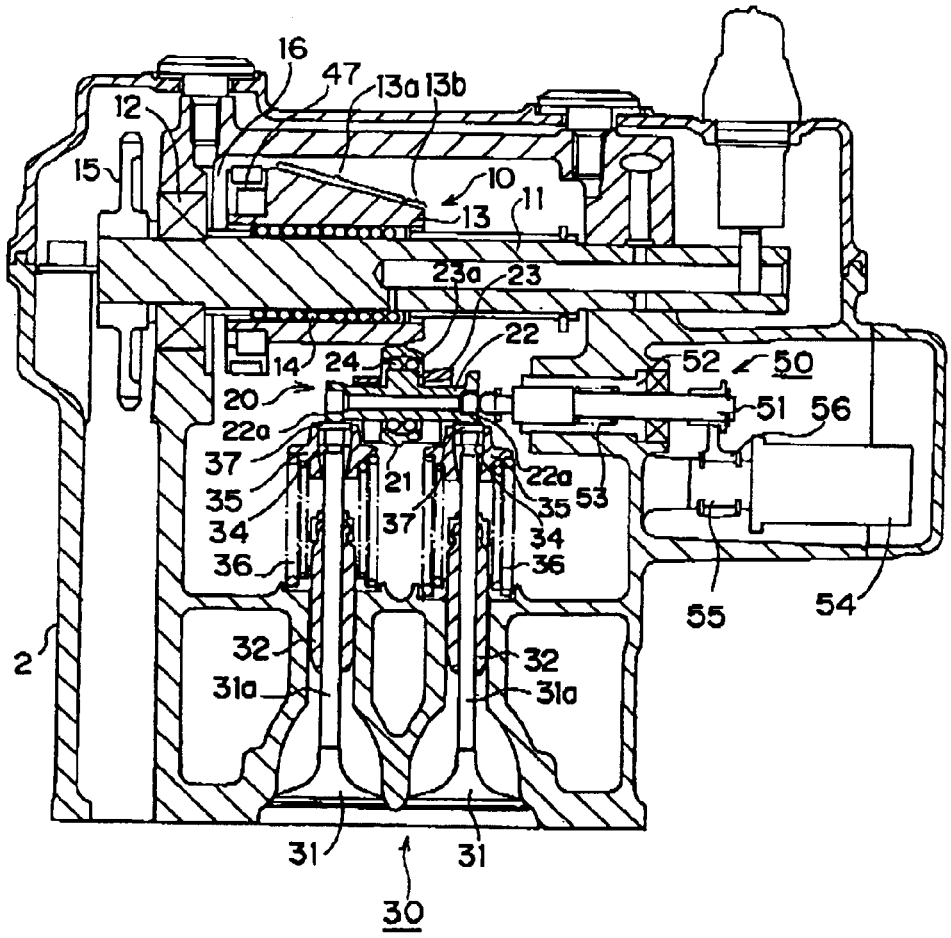
FIG. 3 is a sectional view taken along the line A—A in FIG. 2.
Figure 4:
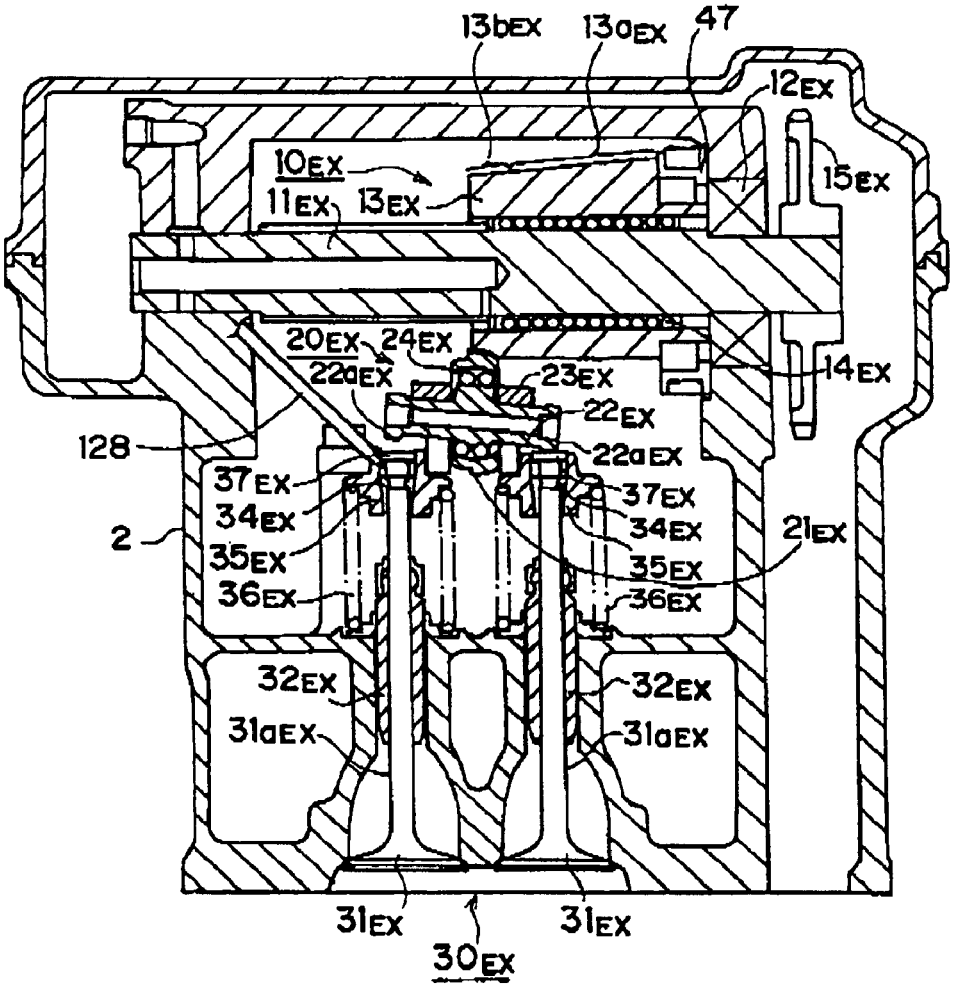
FIG. 4 is a sectional view taken along the line B—B in FIG. 2.
Figure 5:
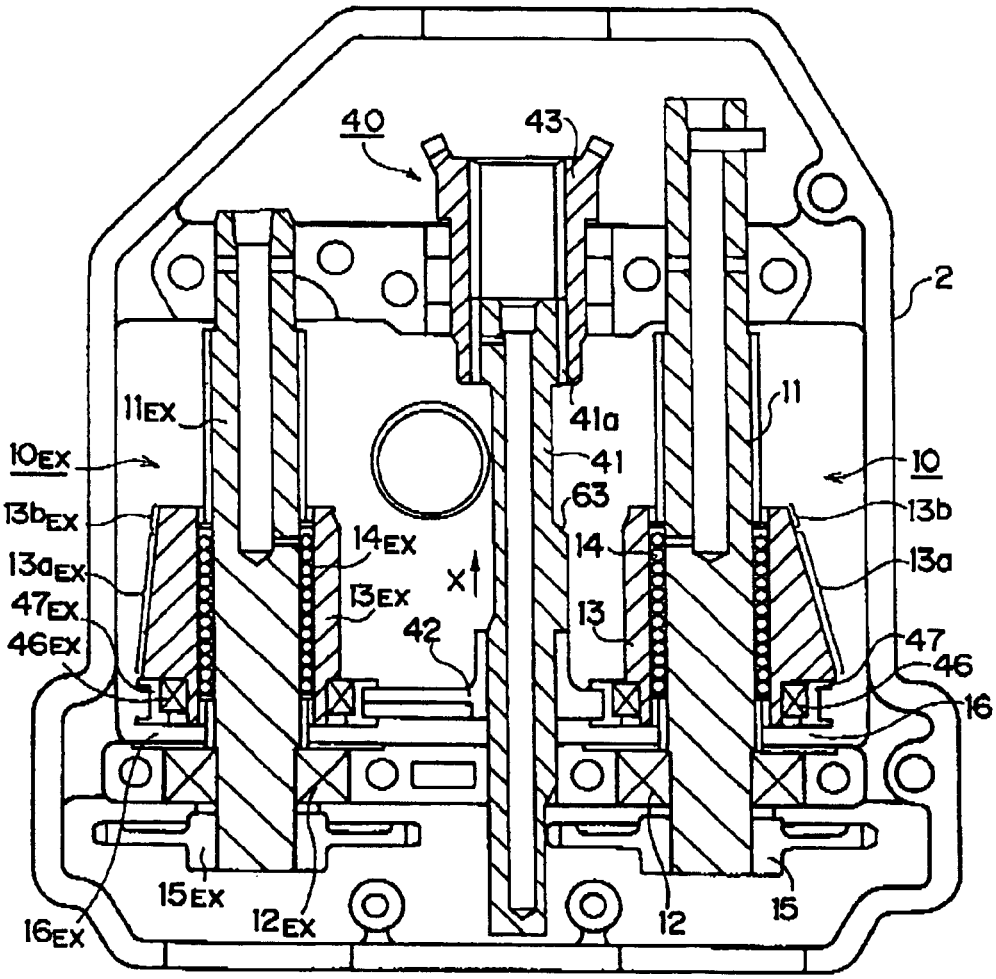
FIG. 5 is a sectional view taken along the line C—C in FIG. 4.

FIG. 2 is a sectional view showing an essential part of the valve driving apparatus, FIG. 3 is a sectional view taken along the line A to A in FIG. 2, FIG. 4 is a sectional view taken along the line B to B in FIG. 2, and FIG. 5 is a sectional view taken along the line C to C in FIG. 2. A piston reciprocates up and down inside a cylinder of the engine unit 1 which is an internal combustion engine, and the valve driving apparatus is housed in a cylinder head 2 placed at a top portion of the piston. The engine unit 1 explained in this embodiment is a single-cylinder engine, which has two valves at an intake side (IN) and an exhaust side (EX), respectively.

At the intake side, the valve driving apparatus of this embodiment includes a cam/camshaft unit 10, a tappet unit 20 placed at an underside of the cam/camshaft unit 10, a valve unit 30 for performing an intake control, and a valve stopping unit 50 for stopping one intake valve 31 out of two intake valves 31 constituting the valve unit 30.

At the exhaust side, the apparatus includes a cam/camshaft unit 10$_{EX}$, the tappet unit 20$_{EX}$ placed at an underside of the cam/camshaft unit 10$_{EX}$, and a valve unit 30$_{EX}$ for performing an exhaust control. The apparatus does not include a valve stopping unit at the exhaust side.

An accelerator shaft unit 40 for displacing cams 13 and 13$_{EX}$ of the cam/camshaft units 10 and 10$_{EX}$ in accordance with an accelerator opening is included, and in this embodiment, the accelerator shaft unit 40 is placed between the cam/camshaft unit 10 at the intake side and the cam/camshaft unit 10$_{EX}$ at the exhaust side, and is commonly used at the intake side and the exhaust side.

A camshaft 11 rotatably supported via a bearing 12 in the cylinder head 2 is included in the cam/camshaft unit 10 at the intake side, as shown in FIGS. 3 and 5. A sprocket 15 is fixed to one end of the camshaft 11. A cam chain is mounted to be wound around the sprocket 15 at the intake side, a sprocket 15$_{EX}$ fixed to one end of a camshaft 11$_{EX}$ at the exhaust side, and a drive sprocket fixed to one end of the crankshaft not shown.

The cam 13 is mounted to the camshaft 11 slidably in an axial direction thereof, and in this example, a spline with balls 14 interposed between the camshaft 11 and the cam 13 is constituted, so that relative rotation of the cam 13 and the camshaft 11 is restrained, and the cam 13 performs linear motion. The camshaft 11 has a hollow structure, and a lubricant oil path is formed in its hollow interior part to make it possible to fill oil to the spline portion and the like.

Here, the cam 13 is constituted as a "three-dimensional cam", and has a cam surface 13*a* inclined in a longitudinal direction (axial direction of the camshaft 11), which is formed into a shape to change the valve lift amount continuously. In this case, it Is set such that the cam operation angle and lift timing are changed synchronously with the cam height, namely, the cam operation angle becomes larger as the valve lift amount becomes larger, and further the lift timing of the valve is also capable of being changed.

In this embodiment, a shim attaching and detaching surface 13*b* having a sectional portion with a smaller diameter than a base circle (non-profile area) of the cam surface 13*a* is formed adjacently to a minimum lift portion (a region with the lowest cam height and non-lift profile area) of the cam surface 13*a*, in the cam 13 in a state in which the cam 13 is at a minimum lift position (see FIG. 3), a space 16 is secured adjacently to a maximum lift portion side end portion (a region with the highest cam height) of the cam 13. Accordingly, by sliding the cam 13 in a direction of the space 16, the shim attaching and detaching surface 13*b* can be located on a tappet roller 21 of the tappet unit 20 which will be described later.

The cam/camshaft unit $\mathbf{10}_{EX}$ at the exhaust side is the same as the cam/camshaft unit 10 at the intake side in the basic constitution, but the concrete specifications of the cam $\mathbf{13}_{EX}$ differs from the cam 13.

In the tappet unit 20 at the intake side, the tappet roller 21 of which outer circumference surface is formed to be a spherical surface is included as shown in FIG. 3, and the outer circumference surface contacts the cam 13. Out of the outer circumference surface of the tappet roller 21, one side portion which does not contact the cam 13 is made thin for the purpose of reduction in weight or the like.

An arm member 22 is placed inside the tappet roller 21. An inner circumference surface of the tappet roller 21 is made a spherical surface, balls 24 are interposed between the inner circumference surface and a large diameter portion at a center of the arm member 22. Accordingly, the tappet roller 21 is rotatably supported via the balls 24 and the arm member 22 is made slidable. Consequently, a core adjusting function which makes the tappet roller 24 normally rotatable even when the arm member 22 is inclined with respect to the tappet roller 21 is exhibited.

A tappet guide 23 is placed to cover the arm member 22. The tappet guide 23 has a substantially inversed concave shape seen from a front direction (FIG. 2), and both end portions of the arm member 22 are protruded from both end openings as shown in FIG. 3. The tappet guide 23 is fixed to the cylinder head 2 by a mounting bolt 25.

A guide hole 23*a* is formed on a top surface of the tappet guide 23, and the tappet roller 21 is placed inside the guide hole 23*a*. The guide hole 23*a* is formed along an axial direction of a valve stem, whereby the tappet roller 21 becomes movable in only an axial direction of the valve stem. The tappet roller 21 is pressed by the cam surface 13*a* of the cam 13, and thereby the tappet roller 21 functions as a valve lifter for advancing and retreating the valve.

An inside of a top surface of the tappet guide 23 is inclined so as to be higher from a left end to a right end in FIG. 3. In a state in which the tappet roller 21 abuts to the minimum lift portion of the cam surface 13*a* with the valve lift amount being 0, the lowest end portion of the inside of the top surface of the tappet guide 23 (left end in FIG. 3) abuts to the arm member 22.

At both end portions of the arm member 22, pressing portions 22*a* abutting to a tappet shim 37 of a valve unit 30 which will be described later are provided. The arm member 22 is made hollow, and at the intake side, one end opening thereof functions as an engaging portion with a tappet stopper 51 of a valve stopping unit 50, which will be described later. When the arm member 22 is not restrained by the tappet stopper 51, the arm member 22 moves up and down while keeping substantial parallelism with the camshaft 11, but when it is restrained by the tappet stopper 51, it swings with the engaging portion with the tappet stopper 51 as a support point.

The tappet unit $\mathbf{20}_{EX}$ at the exhaust side is similar to the valve unit 30 at the intake side in a basic constitution as shown in FIG. 4, and is inclined so that an inner side of a top surface of a tappet guide $\mathbf{23}_{EX}$ is higher from the right end to the left end in FIG. 4. However, unlike the valve unit 30 at the intake side, a space is secured between a lowest end portion (the right end in FIG. 4) of the inner side of the top surface of the tappet guide $\mathbf{23}_{EX}$ and an arm member $\mathbf{22}_{EX}$ in a state in which a tappet roller $\mathbf{21}_{EX}$ abuts to a minimum lift portion of a cam surface $\mathbf{13}a_{EX}$ with the valve lift amount being 0 (FIG. 4 is a state in which the tappet roller $\mathbf{21}_{EX}$ abuts to a shim attaching and detaching surface $\mathbf{13}b_{EX}$, and the space does not exist).

In the valve unit 30 at the intake side, as shown in FIGS. 2 and 3, two intake valves 31 in which valve stems 31*a* are guided by valve guides 32 are included. As a result that the intake valve 31 is lifted, a mixture of air introduced from the air cleaner 114 via an intake port 33 and a fuel sprayed from an injector 127 placed at a downstream side of the intake port 33 is introduced into a combustion chamber.

A valve retainer 35 is provided at an end portion of each of the valve stems 31*a* via a collet 34, and an elastic force of a valve spring 36 acts on the valve retainer 35. Further, a tappet shim 37 is mounted at an upper end opening of the valve retainer 35, and the valve retainer 35 is pressed by the pressing portion 22*a* of the arm member 22 via this tappet shim 37.

A valve unit $\mathbf{30}_{EX}$ at the exhaust side is the same as the valve unit 30 at the intake side in the basic constitution.

In the accelerator shaft unit 40, as shown in FIGS. 2 and 5, an accelerator shaft 41 placed between the camshafts 11 and $\mathbf{11}_{EX}$ in parallel, and an accelerator fork 42 fixed to the accelerator shaft 41 and connected to the cams 13 and $\mathbf{13}_{EX}$ are included.

Figure 6:
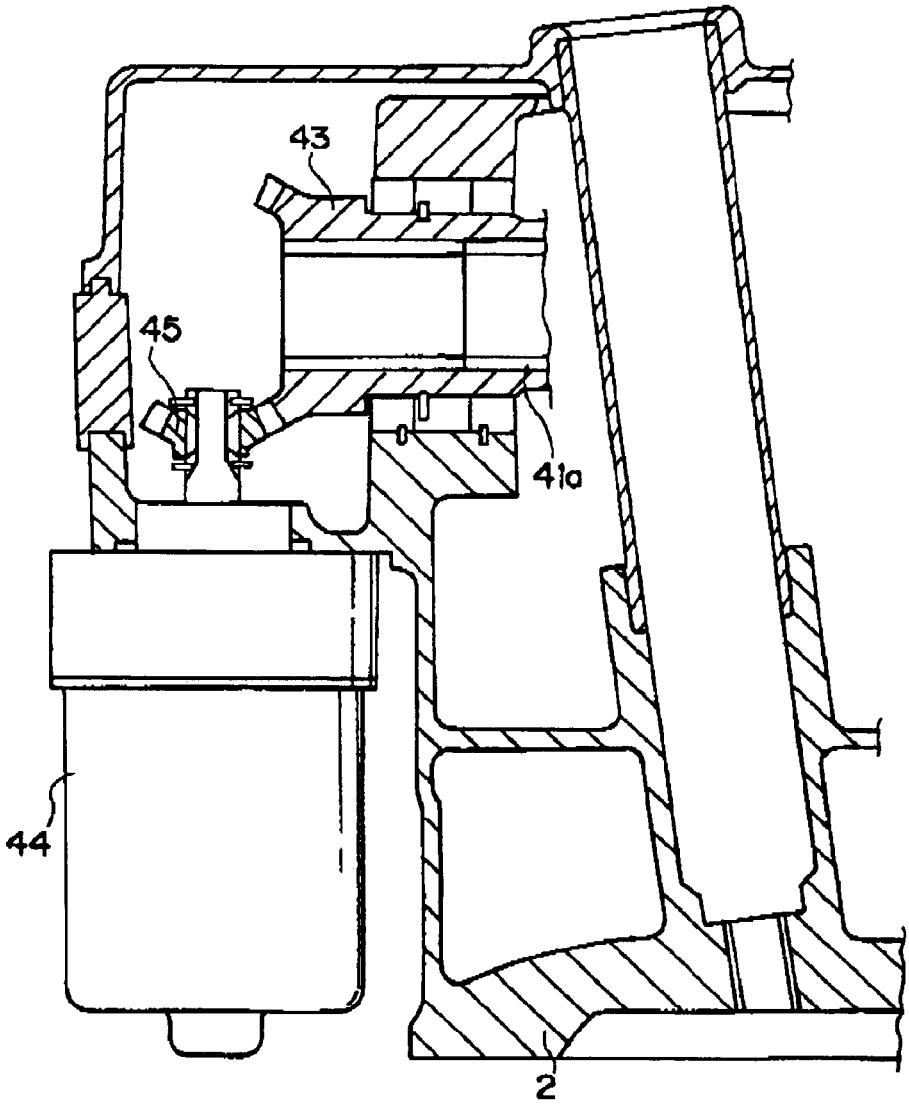
FIG. 6 is a view showing a constitution of an accelerator motor 44 and its peripheral part.

The accelerator shaft 41 is supported slidably in an axial direction, and screwed into a driven gear 43 (bevel gear) via a feed screw 41*a* at one end side. The driven gear 43 is rotatably supported at the cylinder head 2, and is meshed with a drive gear 45 (bevel gear) fixed to an output shaft of an accelerator motor 44, as shown in FIG. 6.

The accelerator fork 42 extends to the sides of the camshafts 11 and $\mathbf{11}_{EX}$ in a direction perpendicular to the accelerator shaft 41, and has tip end portions each in a bifurcated shape. At end portions of the cams 13 and $\mathbf{13}_{EX}$, fork guides 47 and $\mathbf{47}_{EX}$ made rotatable via bearings 46 and $\mathbf{46}_{EX}$ are included. The tip ends each in a bifurcated shape of the accelerator fork 42 are engaged with engaging grooves of the fork guides 47 and $\mathbf{47}_{EX}$ and are made movable along the engaging grooves. As a result, the cams 13 and $\mathbf{13}_{EX}$ respectively slide along the camshafts 11 and $\mathbf{11}_{EX}$, interlocked or synchronized with the accelerator shaft 41 sliding in its axial direction.

In the valve stopping unit 50, as shown in FIG. 3, a tappet stopper 51 constituted to stop one intake valve 31 out of the two intake valves 31 constituting the valve unit 30 at the intake side is included. The tappet stopper 51 is inserted into a sleeve 52 mounted to the cylinder head 2, and is slidable in parallel with the camshaft 11.

A tip end of the tappet stopper 51 is in a spherical shape capable of engaging with the one end opening of the arm member 22. A spring 53 for biasing the tappet stopper 51 to the side of the arm member 22 is fitted into the sleeve 52. A driving device 54 advances a driving shaft 55 to drive the tappet stopper 51 forward via a fork 56.

Figure 7:
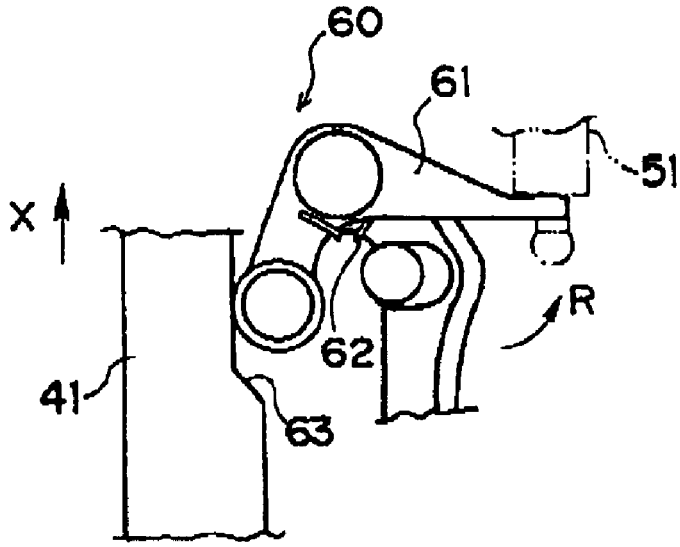
FIG. 7 is a view showing a releasing mechanism 60 for releasing a valve stopped state.

As shown in FIG. 7, a releasing mechanism 60 for releasing a valve stopped state by the valve stopping unit 50 is included. The releasing mechanism 60 includes an arm 61 bent substantially at the right angle, and a tip end portion in a bifurcated shape of the arm 61 engages with the tip end of the tappet stopper 51, while a roller portion at the other end abuts to the accelerator shaft 41. The arm 61 is rotatably supported at a bent portion, and a spring 62 for biasing the other end of the arm 61 to the side of the accelerator shaft 41 is fitted to its rotational shaft portion.

A step portion 63 is formed at a predetermined position of the accelerator shaft 41, and when the accelerator shaft 41 slides in the direction of the arrow X from the state shown in FIG. 7, the arm 61 rotates in the direction of the arrow R in such a manner as to get over the step portion 63, therefore making it possible to retreat the tappet stopper 51 to release the valve stopped state.

Reference numeral 70 in the drawing denotes a cam position sensor for detecting a position of the cam 13, and includes a link arm 72 for converting linear movement of the cam 13 into rotational movement, and a rotary encoder 71 for detection the rotational movement of the link arm 72.

In the valve driving apparatus constituted as described above, when an accelerator grip (or an accelerator pedal) is operated, the accelerator motor 44 is actuated, and by the rotation of its output shaft, the accelerator shaft 41 slides via the driven gear 43. The cams 13 and $\mathbf{13}_{EX}$ slide along the cam shafts 11 and $\mathbf{11}_{EX}$, interlocked with the movement of the accelerator shaft 41 via the accelerator fork 42. In this embodiment, the continuously variable control of the valve lift amount and the actuated angle is also performed in accordance with the accelerator opening at the exhaust side in addition to the intake side.

The intake and exhaust amount is thus controlled from an idle rotation range to a full opened range, and intake and exhaust which are the most suitable for the engine speed (or vehicle speed) can be performed. For example, at a time of low engine speed, the tappet roller 21 abuts to the cam surfaces 13*a* and $\mathbf{13}a_{EX}$ of the cams 13 and $\mathbf{13}_{EX}$ at a region with comparatively low cam height.

When acceleration is performed, namely, the accelerator is opened in this state, the driven gear 43 is rotated by the actuation of the accelerator motor 44, and the accelerator shaft 41 slides in the direction of the arrow X in FIG. 5. The cams 13 and $\mathbf{13}_{EX}$ similarly slides in the direction of the arrow X along the camshafts 11 and $\mathbf{11}_{EX}$, interlocked with the movement of the accelerator shaft 41 via the accelerator fork 42. As a result that the cams 13 and $\mathbf{13}_{EX}$ slide, the tappet rollers 21 and $\mathbf{21}_{EX}$ gradually abut to the region with comparatively high cam height, and the valve lift amount is increased.

Meanwhile, at a time of deceleration, the accelerator is returned, whereby the valve lift amount is decreased by the reverse operation from the above description.

In a low and medium speed range of the engine, the movement of the one end of the arm member 22 is restrained by the tappet stopper 51 at the intake side. As a result, the arm member 22 swings with the engaging portion with the tappet stopper 51 as a support point, and one of the intake valves 31 is stopped while only the other intake valve 31 is lifted, whereby intake swirl is generated in the combustion chamber and so-call lean burn is made possible. In this case, the output power is increased by increasing the injection speed of the fuel.

Since the arm member 22 swings with the engaging portion with the tappet stopper 51 as the support point in the valve stopped state, the valve lift amount of the other intake valve 31 increases as compared with the normal valve lift amount in which both the intake valves 31 are lifted. In the valve stopped state, the intake is performed by one of the intake ports 33, and due to this itself, the intake resistance becomes high, but an execution valve opening area is enlarged by the increase in the lift amount. This substantially eliminates or minimizes a difference in the intake amount due to the valve opening area and the intake resistance at the time of ON/OFF switching of the valve stop to make it possible to perform smooth switching.

When the engine speed exceeds the low and medium speed range, and the accelerator shaft 41 slides by only a predetermined amount, the arm 61 is rotated by the step portion 63 of the accelerator shaft 41 as described above, and the tappet stopper 51 is retreated to make it possible to release the valve stopped state forcefully.

In the valve driving apparatus of the first embodiment described so far, at the intake side or the exhaust side, the shim thickness of one of the two valves is fixed, and the shim thickness of the other one is adjusted, whereby the clearance adjustment is performed, but on this occasion, time and effort to remove the tappet roller 21 ($\mathbf{21}_{EX}$), the tappet guide 23 ($\mathbf{23}_{EX}$) and the like are not needed, thus making it possible to increase assembling easiness dramatically.

Namely, at a time of shim thickness adjustment the cam 13 ($\mathbf{13}_{EX}$) is slid in the direction of the space 16 ($\mathbf{16}_{EX}$), whereby the shim attaching and detaching surface 13*b* ($\mathbf{13}b_{EX}$) is located on the tappet roller 21 ($\mathbf{21}_{EX}$).

FIG. 3 shows a state in which the cam surface 13*a* of the cam 13 is located on the tappet roller 21 at the intake side. From this state, the cam 13 is slid, and the shim attaching and detaching surface 13*b* is located on the tappet roller. Since the cam 13 has the sectional portion with a smaller diameter at the shim attaching and detaching surface 13*b* than the base circle of the cam surface 13*a*, the tappet roller 21 is allowed to move upward, and the arm member 22 can be swung. Since the inner side of the top surface of the tappet guide 23 is inclined to be higher from the left end to the right end as described above, the arm member 22 is tilted along this inclination.

When the arm member 22 is tilted as above, the one end of the arm member 22 can be raised, and a clearance is formed in a space from the tappet shim 37. Accordingly, a slim plate-shaped or rod-shaped jig 128 is inserted from the clearance as shown in FIG. 4 which will be described later, and thereby the tappet shim 37 can be detached and attached.

FIG. 4 shows a state in which the shim attaching and detaching surface $\mathbf{13}b_{EX}$ is located on the tappet roller $\mathbf{21}_{EX}$ at the exhaust side. Since the cam $\mathbf{13}_{EX}$ has the sectional portion with a smaller diameter at the shim attaching and detaching surface $\mathbf{13}b_{EX}$ than a base circle of the cam surface $\mathbf{13}a_{EX}$, the tappet roller $\mathbf{21}_{EX}$ and the arm member $\mathbf{22}_{EX}$ can be moved upward. Since an inner side of a top surface of the tappet guide $\mathbf{23}_{EX}$ is inclined to be higher from the right end to the left end in FIG. 4 as described above, the arm member $\mathbf{22}_{EX}$ is tilted along this inclination.

When the arm member $\mathbf{22}_{EX}$ is tilted as described above, the one end of the arm member $\mathbf{22}_{EX}$ can be raised, and a clearance is formed in a space from the tappet shim $\mathbf{37}_{EX}$. Accordingly, a slim plate-shaped or rod-shaped jig 128 is inserted from the clearance, and thereby the tappet shim $\mathbf{37}_{EX}$ can be detached and attached.

Figure 8:
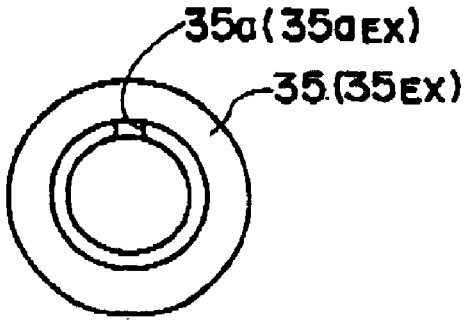
FIG. 8 is a plan view of a valve retainer 35 (35$_{EX}$)

In this case, a notch 35*a* ($\mathbf{35}a_{EX}$) into which a tip end of the jig 128 can be inserted is formed at a side portion of an opening of an upper portion of the valve retainer 35 ($\mathbf{35}_{EX}$) as shown in FIG. 8. The tip end of the jig 128 is inserted from this notch 35*a* ($\mathbf{35}a_{EX}$) into an undersurface side of the tappet shim 37 ($\mathbf{37}_{EX}$), whereby the tappet shim 37 ($\mathbf{37}_{EX}$) can be easily removed due to the principle of leverage.

Concerning the inclination direction of the inner side of the top surface of the tappet guide 23 ($\mathbf{23}_{EX}$), it may be determined so that the jig 128 can be inserted from the direction opposite to the side of the cam 13 ($\mathbf{13}_{EX}$), as shown in FIGS. 3 and 4.

In the above-described embodiment, an example in which the shim attaching and detaching surface 13*b* is formed on the cam 13 independently from the cam surface 13*a* is explained, but in the intake side, a sectional portion with a smaller diameter than the base circle of the cam surface 13*a* may be included by forming a recess at the minimum lift portion of the cam surface 13*a*.

Namely, in the intake side, in the low speed range of the engine, the arm member 22 swings with the engaging portion with the tappet stopper 51 as the support point, and the upward movement of the end portion at the opposite side from the engaging portion is restrained by the lowest end portion of the inner side of the top surface of the tappet guide 23 working as the restraining means. Accordingly, the recess at the minimum lift portion of the cam surface 13*a* can restrain the arm member 22 from jumping up.

When the part of the cam surface is utilized as the shim attaching and detaching surface, instead of specially providing the shim attaching and detaching surface 13*b* at the cam 13, the space 16 where the cam 13 is slid to locate the shim attaching and detaching surface 13*b* on the tappet roller 21 is not needed. Accordingly, the slide amount of the cam 13 at the time of engine rotation can be correspondingly made larger, and the inclined angle of the cam surface 13*a* can be made small, thus making it possible to reduce the width of the tappet roller 21 and realize high speed rotation.

Second Embodiment

A second embodiment will be explained with reference to FIGS. 9 to 11 hereinafter. The advancing and retreating mechanism of the valve is explained in the above-described first embodiment, and in the second embodiment, what increases assembling easiness and the like in the slide mechanism of the cam will be explained. In the valve driving apparatus of the second embodiment, the structure for shim thickness adjustment (the shim attaching and detaching surface 13*b* of the cam 13, the space 16 and the like) explained in the above-described first embodiment is not adopted, but the basic constitution is the same, and therefore the same reference numerals and symbols are given to the components explained in the first embodiment and the detailed explanation thereof will be omitted.

As also explained in the above-described first embodiment, the cam 13 ($\mathbf{13}_{EX}$) is mounted to the camshaft 11 ($\mathbf{11}_{EX}$) slidably in its axial direction. In the above-described first embodiment, three convex portions parallel in the axial direction are formed on the outer circumference surface of the camshaft 11 ($\mathbf{11}_{EX}$), but in this embodiment, a key groove 11*a* ($\mathbf{11}_{EX}$) parallel in the axial direction is formed on the outer circumference surface of the camshaft 11 ($\mathbf{11}_{EX}$), and a slim plate-shaped key 17 ($\mathbf{17}_{EX}$) is fitted into the key groove 11*a* ($\mathbf{11}a_{EX}$). It is the same as the first embodiment that three grooves 13*c* ($\mathbf{13}c_{EX}$) parallel in the axial direction are formed on the inner circumference surface of the cam 13 ($\mathbf{13}_{EX}$).

As also explained in the above-described first embodiment, the balls 14 ($\mathbf{14}_{EX}$) are interposed between the camshaft 11 ($\mathbf{11}_{EX}$) and the cam 13 ($\mathbf{13}_{EX}$). In the above-described first embodiment, the balls 14 ($\mathbf{14}_{EX}$) independent from each other are inserted between the camshaft 11 ($\mathbf{11}_{EX}$) and the cam 13 ($\mathbf{13}_{EX}$), but in this embodiment, cages 18 ($\mathbf{18}_{EX}$) are used, and the cages 18 ($\mathbf{18}_{EX}$) are placed at three spots in the circumferential direction and each holds groups of the balls 14 ($\mathbf{14}_{EX}$) of two rows parallel in the axial direction. Bearing assemblies with the balls 14 ($\mathbf{14}_{EX}$) and the cages 18 ($\mathbf{18}_{EX}$) being assembled are interposed between the cam 13 ($\mathbf{13}_{EX}$) and the camshaft. 11 ($\mathbf{11}_{EX}$), and are prevented from coming off by the retainers and the circlips.

Figure 11:
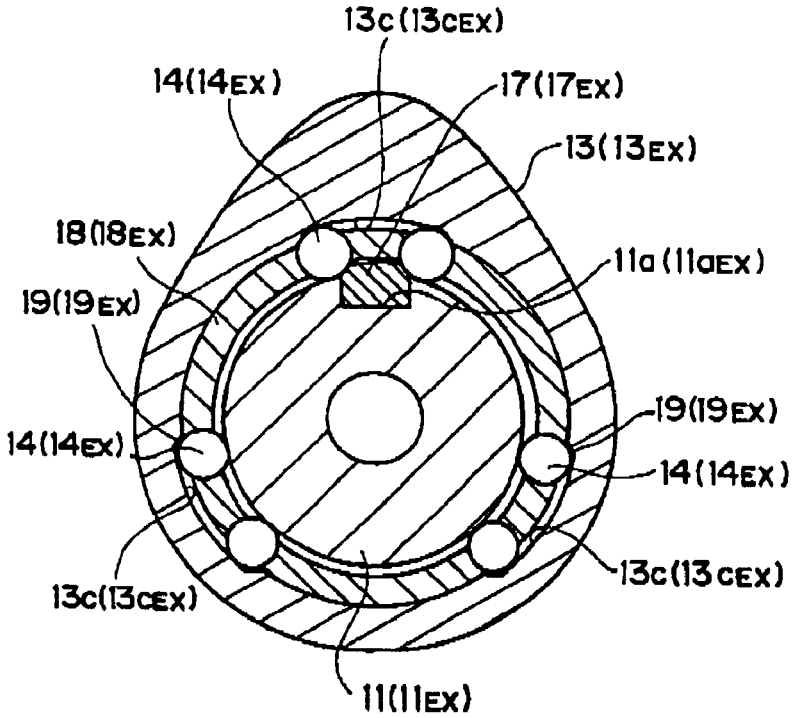
FIG. 11 is an enlarged view of a cam 13 (13$_{EX}$) and camshaft 11 (11$_{EX}$) section.

In this case, as shown in FIG. 11, the balls 14 ($\mathbf{14}_{EX}$) are engaged by both ends of the key 17 ($\mathbf{17}_{EX}$) and the groove 13*c* ($\mathbf{13}c_{EX}$) of the cam 13 ($\mathbf{13}_{EX}$) to restrain the cam 13 ($\mathbf{13}_{EX}$) from relatively rotating with the cam shaft 11 ($\mathbf{11}_{EX}$). A rotation torque reaction force for relatively rotating the cam 13 ($\mathbf{13}_{EX}$) and the camshaft 11 ($\mathbf{11}_{EX}$) is caused by the valve spring 36 ($\mathbf{36}_{EX}$), and even with rotation restrain at one spot, sufficient durability can be obtained.

At the two spots of the key 17 ($\mathbf{17}_{EX}$) portion, the balls 14 ($\mathbf{14}_{EX}$) functions as bearings in a diameter direction of the cam 13 ($\mathbf{13}_{EX}$) and the camshaft 11 ($\mathbf{11}_{EX}$), but do not restrain them in the relative rotation direction. Accordingly, a clearance 19 ($\mathbf{19}_{EX}$) is formed between the balls 14 ($\mathbf{14}_{EX}$) and the both side portions of the groove 13*c* ($\mathbf{13}c_{EX}$) of the cam 13 ($\mathbf{13}_{EX}$), and they can be made non-contact with each other, therefore making it unnecessary to secure size accuracy of the width of the groove 13*c* ($\mathbf{13}c_{EX}$), the size of the ball 14 ($\mathbf{14}_{EX}$) and the like strictly.

In the valve driving apparatus of the second embodiment described above, the constitution in which the key 17 ($\mathbf{17}_{EX}$) is fitted into the key groove 11*a* ($\mathbf{11}a_{EX}$) on the outer circumference surface of the camshaft 11 ($\mathbf{11}_{EX}$) is adopted, and therefore time and efforts to form the convex portions constituting splines on the outer circumference surface of the camshaft 11 ($\mathbf{11}_{EX}$) become unnecessary, which facilitates machining thereof.

When the convex portions are integrally formed on the outer circumference surface of the camshaft 11 ($\mathbf{11}_{EX}$), the size accuracy of the convex portions and the grooves 13*c* ($\mathbf{13}a_{EX}$) on the inner circumference surface of the cam 13 ($\mathbf{13}_{EX}$) has to be secured, but in this embodiment, if only the size accuracy of the key 17 ($\mathbf{17}_{EX}$) is secured, a clearance or the like between the balls 14 ($\mathbf{14}_{EX}$), and the cam 13 ($\mathbf{13}_{EX}$) and the camshaft 11 ($\mathbf{11}_{EX}$) can be adjusted, thus making it possible to increase assembling easiness. For example, a plurality of keys with different heights and widths are prepared, for example, as the key 17 ($\mathbf{17}_{EX}$), and a suitable key may be selected from them, thus making it possible to increase assembling easiness dramatically.

The assemblies of the balls 14 ($\mathbf{14}_{EX}$) and the cage 18 ($\mathbf{18}_{EX}$) only have to be inserted between the cam 13 ($\mathbf{13}_{EX}$) and the camshaft 11 ($\mathbf{11}_{EX}$), and therefore assembling easiness can be dramatically increased.

Figure 9:
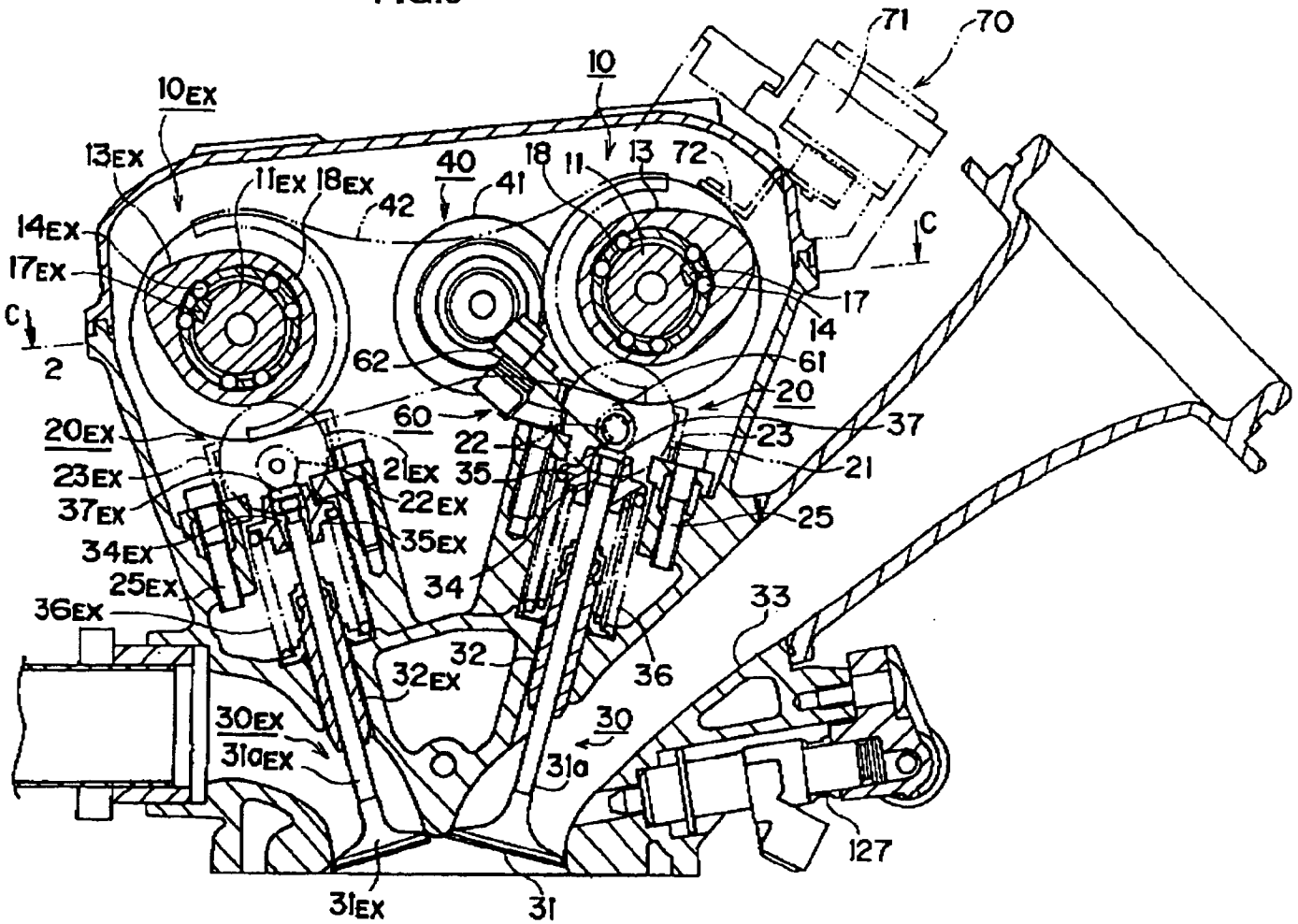
FIG. 9 is a sectional view showing an essential part of a valve driving apparatus of a second embodiment.
Figure 10:
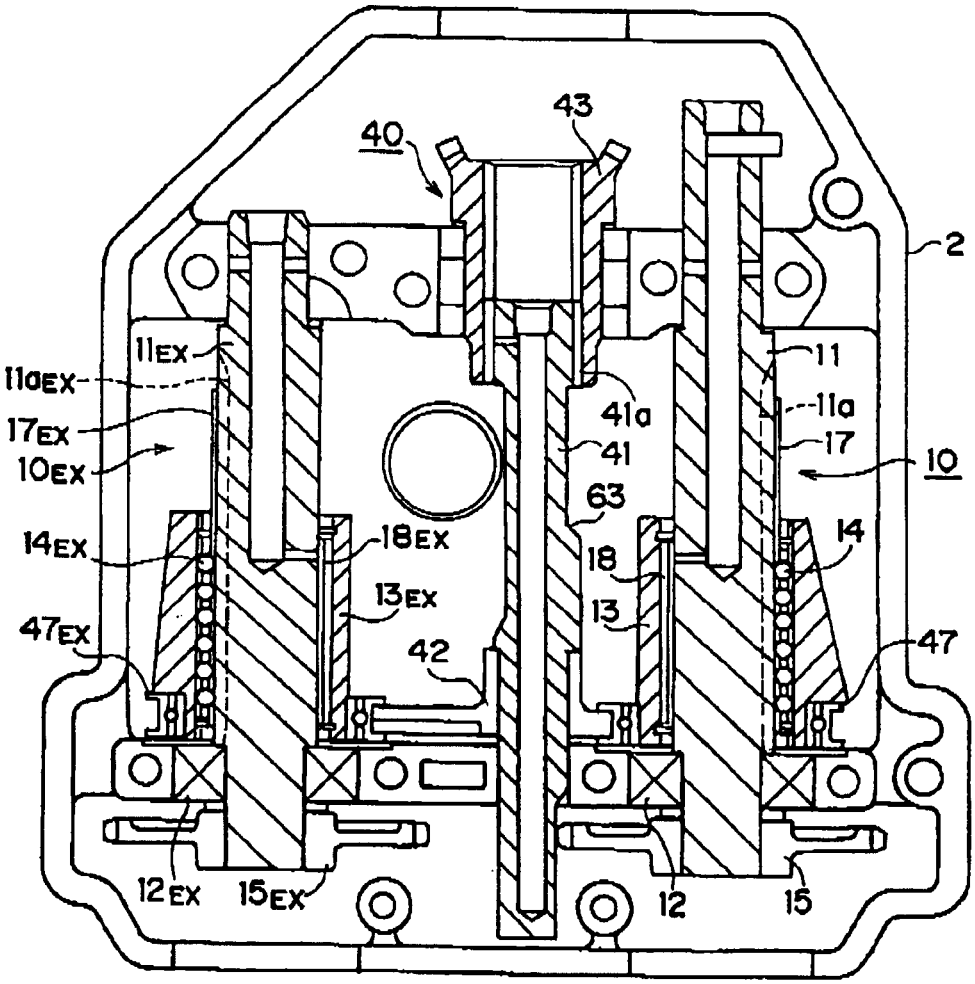
FIG. 10 is a sectional view taken along the line C-C in FIG. 9.

A single-cylinder engine is explained in FIGS. 9 to 11, but when a multi-cylinder engine is used, more remarkable effects can be obtained. Namely, when a plurality of cams 13 ($\mathbf{13}_{EX}$) corresponding to multiple cylinders are mounted to one camshaft 11 ($\mathbf{11}_{EX}$), the camshaft 11 ($\mathbf{11}_{EX}$) becomes long correspondingly, and therefore machining and the like become difficult on constructing the splines by integrally forming the convex portions. On the other hand, in the constitution n which the key 17 ($\mathbf{17}_{EX}$) is fitted into the key groove 11*a* ($\mathbf{11}a_{EX}$) as in this embodiment, machining of the camshaft 11 ($\mathbf{11}_{EX}$) is easy.

It is necessary to displace the phase of the cam 13 ($\mathbf{13}_{EX}$) in suitable timing for each cylinder, but in the case in which the convex portions are integrally formed on the outer circumference surface of the camshaft 11 ($\mathbf{11}_{EX}$), it is necessary to prepare the one with spline phase changed with respect to the cam crest of the cam 13 ($\mathbf{13}_{EX}$). On the other hand, in this embodiment, the key groove 11*a* ($\mathbf{11}a_{EX}$) only has to be formed to correspond to the phase of the cam 13 ($\mathbf{13}_{EX}$) for each cylinder, and therefore it is also possible to use the cam 13 ($\mathbf{13}_{EX}$) commonly for each cylinder.

When the phase of the key 17 ($\mathbf{17}a_{EX}$) is displaced for each cylinder, it is possible to use the end surface as a stopper for preventing the adjacent cam 13 ($\mathbf{13}_{EX}$) from slipping off.

The present invention is explained with various embodiments thus far, but the present invention is not limited to only these embodiments, and modifications and the like can be made within the scope of the present invention. For example, the example of the case of the single-cylinder engine is explained in each of the embodiments, but the present invention is effectively applicable to engines with two or more cylinders.

As explained thus far, according to the present invention, the assembling easiness and the like in the slide mechanism of the three-dimensional cam and the valve advancing and retreating mechanism can be increased in the valve driving apparatus constituted to perform continuously variable control of the valve lift amount and the valve actuated angle by the three dimensional-cam sliding in the axial direction of the camshaft.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A valve driving apparatus comprising a cam, with a cam surface being formed so that a cam height and a cam operation angle continuously change, constituted to be rotated integrally with a camshaft and slidable in an axial direction thereof, and a valve lifter pressed by the cam surface of said cam to advance and retreat a valve via a shim, so that continuously variable control of a valve lift amount and a valve actuated angle is performed by said cam sliding in the axial direction of the camshaft, wherein said cam is provided with a shim attaching and detaching surface formed at said cam independently from the cam surface with a clearance being secured between said valve lifter and a shim of the valve to make the shim attachable and detachable from the clearance and the shim attaching and detaching surface has a sectional portion with a smaller diameter than a base circle of the cam surface.

2. An internal combustion engine for controlling intake and exhaust by intake valves and exhaust valves, comprising:

the valve driving apparatus according to claim 1.

3. A valve driving apparatus comprising a cam, with a cam surface being formed so that a cam height and a cam operation angle continuously change, constituted to be rotated integrally with a camshaft and slidable in an axial direction thereof, a valve lifter pressed by the cam surface of said cam to advance and retreat a valve via a shim, so that continuously variable control of a valve lift amount and a valve actuated angle is performed by said cam sliding in the axial direction of the camshaft, wherein said cam is provided with a shim attaching and detaching surface formed at said cam independently from the cam surface with a clearance being secured between said valve lifter and a shim of the valve to make the shim attachable and detachable from the clearance and the shim attaching and detaching surface has a sectional portion with a smaller diameter than a base circle of the cam surface, an arm member for advancing and retreating valves respectively at both end portions;

valve stopping means for restraining movement of one end of said arm member and swinging said arm member to stop a valve at the one end side; and restraining means for restraining the other end of said arm member from moving upward from a predetermined position, wherein a surface for pressing said valve lifter in a valve stopped state by said valve stopping means, of the cam surface of said cam is made to have a sectional portion with a smaller diameter than a base circle of the cam surface, and the cam surface is utilized as the shim attaching and detaching surface.

4. A valve driving apparatus comprising a cam, with a cam surface being formed so that cam height and a cam operation angle continuously change, constituted to be rotated integrally with a camshaft and slidable in an axial direction thereof, and a valve lifter pressed by the cam surface of said cam to advance and retreat a valve, so that continuously variable control of a valve lift amount and a valve actuated angle is performed by said cam sliding in the axial direction of the camshaft, comprising:

a key groove parallel in an axial direction, formed on an outer circumference surface of the camshaft;

a key fitted into said key groove; and a bearing assembly having balls at a plurality of spots in a circumferential direction, wherein said bearing assembly is interposed between said cam and the camshaft, and the balls are engaged between the inner circumference surface of said cam and both ends of said key at the outer circumference surface of the camshaft to restrain said cam from being relatively rotated with the camshaft and make said cam slidable in the axial direction thereof.

5. The valve driving apparatus according to claim 4, wherein cams for multiple cylinders are mounted to one camshaft, and key grooves each with a phase being displaced for each cylinder are formed on the one camshaft.

6. An internal combustion engine for controlling intake and exhaust by intake valves and exhaust valves, comprising:

the valve driving apparatus according to claim 4.

* * * * *